US010109951B1

(12) United States Patent
Hsiao et al.

(10) Patent No.: US 10,109,951 B1
(45) Date of Patent: Oct. 23, 2018

(54) ELECTRICAL CONNECTION STRUCTURE AND ELECTRONIC APPARATUS USING THE SAME

(71) Applicant: Compal Electronics, Inc., Taipei (TW)

(72) Inventors: Yen-Hua Hsiao, Taipei (TW); Chia-Hua Wu, Taipei (TW); Chih-Yuan Lee, Taipei (TW); Yun-Tung Pai, Taipei (TW); Chia-Chi Lin, Taipei (TW)

(73) Assignee: Compal Electronics, Inc. (TW)

( * ) Notice: Subject to any disclaimer, the term of this patent is extended or adjusted under 35 U.S.C. 154(b) by 0 days.

(21) Appl. No.: 15/922,819

(22) Filed: Mar. 15, 2018

(30) Foreign Application Priority Data

Jan. 4, 2018 (TW) ..... 107100369 A

(51) Int. Cl.

| | |
|---|---|
| ***H01R 11/30*** | (2006.01) |
| ***H01R 13/629*** | (2006.01) |
| ***H01R 4/28*** | (2006.01) |
| ***H01R 13/46*** | (2006.01) |
| ***H01R 13/62*** | (2006.01) |

(52) U.S. Cl.
CPC ..... *H01R 13/629* (2013.01); *H01R 4/28* (2013.01); *H01R 13/46* (2013.01); *H01R 13/6205* (2013.01)

(58) Field of Classification Search
CPC .... H01R 13/629; H01R 4/28; H01R 13/6205; H01R 13/46
USPC ..... 439/32, 39
See application file for complete search history.

(56) References Cited

U.S. PATENT DOCUMENTS

| | | | | |
|---|---|---|---|---|
| 9,471,110 | B2 * | 10/2016 | Wu | G06F 1/1681 |
| 9,886,064 | B2 * | 2/2018 | Lai | G06F 1/1654 |
| 2015/0192957 | A1 | 7/2015 | Lee | |

FOREIGN PATENT DOCUMENTS

| | | |
|---|---|---|
| TW | I307006 B | 3/2009 |

* cited by examiner

*Primary Examiner* — Khiem Nguyen

(57) ABSTRACT

An electrical connection structure includes a housing, a connector, a pushing component and a lifting component. The housing has a top portion, a bottom portion and a groove between the top portion and the bottom portion. The connector is disposed in the groove. The pushing component is disposed in the groove and a part thereof is exposed from the opening of the top portion. The lifting component is disposed in the groove and connected between the pushing component and the connector. When the electrical connection structure is connected to the electronic device, the electronic device pushes the pushing component to move in a first direction toward the bottom portion, so that the pushing component drives the lifting component to move in a second direction opposite to the first direction and toward the top portion, so that the lifting component lifts up the connector to be connected to the connection interface.

22 Claims, 8 Drawing Sheets

ELECTRICAL CONNECTION STRUCTURE AND ELECTRONIC APPARATUS USING THE SAME

FIELD OF THE INVENTION

The present invention relates to an electrical connection structure, and more particularly to an electrical connection structure adapted to be connected with an electronic device.

BACKGROUND OF THE INVENTION

In recent years, electronic devices such as notebooks (NBs), tablet PCs and smart phones have appeared frequently in daily life as the technology industry has become increasingly developed. Electronic devices are more and more diversified in terms of their functions and usage. Convenience and practicability make these electronic devices more popular, and they can be used for different purposes according to users' needs. In addition, in order to improve the practicability of the electronic device, many electronic devices may be connected to a docking station, for example, a keyboard device or a sound source device, so as to increase an operating function of the electronic device by the docking station.

The electronic device and the docking station are electrically connected to each other via the corresponding connection interface and the connector. In the case of repeated insertion and removal of the electronic device and the docking station, the connector of the docking station is easily damaged. In addition, when the electronic device is connected to the docking station, the connector of the docking station is often damaged due to inaccurate connections. Therefore, how to improve the above problems is indeed the focus of attention of relevant persons in this field.

SUMMARY OF THE INVENTION

One objective of the present invention is to provide an electrical connection structure for easy connection and disconnection with an electronic device.

Another objective of the present invention is to provide an electronic apparatus having an electrical connection structure and an electronic device that are easy to connect and disassemble to each other.

Other objectives and advantages of the present invention can be further understood from the technical features disclosed in the present invention.

In order to achieve a part of or all of the above objectives or other objectives, the present invention provides an electrical connection structure, which includes a housing, a connector, a pushing component and a lifting component. The housing has a top portion, a bottom portion opposite to the top portion, and a groove located between the top portion and the bottom portion. The top portion has an opening, and the groove is in communication with the opening. The connector is disposed in the groove. The pushing component is disposed in the groove, and a part of the pushing component is exposed from the opening of the top portion. The lifting component is disposed in the groove and connected between the pushing component and the connector. When the electrical connection structure is connected to the electronic device, the electronic device pushes the pushing component to move in a first direction toward the bottom portion, so that the pushing component drives the lifting component to move in a second direction toward the top portion, the second direction is opposite to the first direction, so that the lifting component lifts up the connector to be connected to the connection interface.

In an embodiment of the present invention, the groove of the housing further has a side wall and a bottom end adjacent to each other. The side wall surrounds the connector, the pushing component and the lifting component. The bottom end is opposite to the opening. The pushing component includes a push follower and at least one push driver. The push follower is exposed from the opening of the top portion and has an opening corresponding to the connector. The push drivers extend from the push follower toward the bottom portion of the housing and respectively located on at least one side of the connector.

In an embodiment of the present invention, the push follower further has a contact portion facing the electronic device. The opening is located at the contact portion, and the contact portion and the top portion of the housing are coplanar with each other.

In an embodiment of the present invention, the push follower further has a contact portion facing the electronic device. The opening is located at the contact portion. The push follower protrudes from the opening of the top portion so that the contact portion has a gap from the top portion of the housing.

In an embodiment of the invention, the electrical connection structure further includes at least one first positioning axis, at least one first axis and at least one second axis. The first positioning axes are disposed on the side wall of the groove. The first axes are respectively disposed on one side of the corresponding push driver. The second axes are disposed on the connector. The lifting component includes at least one connecting rod. Each connecting rod has a first-sectional connecting rod, a second-sectional connecting rod, a first sliding slot and a second sliding slot. The first sliding slot is located between the first-sectional connecting rod and the second-sectional connecting rod. The first-sectional connecting rod is located between the first sliding slot and the second sliding slot. The first sliding slots are respectively pivotally connected to the corresponding first positioning axis. The second sliding slots are respectively pivotally connected to the corresponding first axis. The second-sectional connecting rods are pivotally connected to the corresponding second axis. When the electrical connection structure is connected to the electronic device, the electronic device pushes the push follower and the push drivers to move in the first direction. The push drivers drive the corresponding connecting rod to rotate with the corresponding first positioning axis as a fulcrum so as to move the first-sectional connecting rods in the first direction and drive the second-sectional connecting rods to move in the second direction, so that the second-sectional connecting rods lift up the connector to pass through the opening of the push driver and to be connected to the connection interface.

In an embodiment of the present invention, the electrical connection structure further includes at least one elastic member. The elastic members are respectively disposed between one of the push drivers and the bottom end of the groove and between the other one of the push drivers and the bottom end of the groove. When the electrical connection structure is detached from the electronic device, by the elastic restoring force of the elastic members, the push drivers are moved in the second direction and drive the first-sectional connecting rod and the push follower to move in the second direction and drive the second-sectional connecting rod and the connector to move in the first direction.

In an embodiment of the present invention, each first axis has a first gap from the corresponding first positioning axis, each second axis has a second gap from the corresponding first positioning axis, and a specific ratio of the first gap to the second gap is between 1/3 and 1/2.

In an embodiment of the present invention, the electrical connection structure further includes at least one third axis and at least one second positioning axis. The third axes are respectively disposed on one side of the corresponding push driver away from the second axis. The second positioning axis is disposed at the bottom end of the groove. One of the third axes and one of the second positioning axes are located on one side of the groove, and the other one of the third axes and the other one of the second positioning axes are located on the other side of the groove. The electrical connection structure further includes a supporting component disposed in the housing and located on a side thereof away from the lifting component. The supporting component includes a first supporting connecting rod and a second supporting connecting rod stacked on top of each other, and the first supporting connecting rod is pivotally connected to the second supporting connecting rod. One end of the first supporting connecting rod is pivotally connected to the corresponding third axis and the other end of the first supporting connecting rod is pivotally connected to the corresponding second positioning axis. One end of the second supporting connecting rod is pivotally connected to the corresponding third axis and the other end of the second supporting connecting rod is pivotally connected to the corresponding second positioning axis. A pivoting connection between the first supporting connecting rod and the second supporting connecting rod is located between the third axes and the second positioning axes.

In an embodiment of the invention, the electrical connection structure further includes at least one positioning axis. The positioning axes are disposed on the side wall of the groove. The lifting component includes at least one swinging arm. Each swinging arm has a first arm, a second arm and a pivot hole. The pivot hole is located between the first arm and the second arm. The first arms are respectively pivotally connected to the corresponding push driver. The second arms are respectively contacted with different sides of the connector. The pivot holes are pivotally connected to the corresponding positioning axis. When the electrical connection structure is connected to the electronic device, the electronic device pushes the push follower and the push drivers to move in the first direction. The push drivers drive the corresponding swing arm to rotate with the corresponding positioning axis as a fulcrum so as to move the first arms in the first direction and drive the second arms to move in the second direction, so that the second arms lift up the connector to pass through the opening of the push follower and to be connected to the connection interface.

In an embodiment of the present invention, the electrical connection structure further includes at least one elastic member. The elastic members are respectively disposed at a pivoting connection between the first arms and the corresponding push driver. When the electrical connection structure is detached from the electronic device, by the elastic restoring force of the elastic members, the first arms are moved in the second direction and drive the second arms and the connector to move in the first direction and drive the pushing drivers and the push follower to move in the second direction.

In an embodiment of the present invention, the electrical connection structure further includes a first magnetic member and a second magnetic member. The first magnetic member is disposed at the bottom end of the groove. The second magnetic member is disposed on the connector, and the second magnetic member is located between the connector and the first magnetic member. When the electrical connection structure is detached from the electronic device, by the magnetic force between the first magnetic member and the second magnetic member, the connector is moved in the second direction to be fixed at the bottom end, and drives the second arms to move in the first direction and drives the first arms, the push drivers and the push follower to move in the second direction.

In an embodiment of the present invention, the electrical connection structure further includes a first magnetic member and a second magnetic member. The first magnetic member is disposed at the bottom end of the groove and corresponds to one of the swing arms. The second magnetic member is disposed at the bottom end of the groove and corresponds to the other one of the swing arms. By the magnetic force between the first magnetic member and the second magnetic member respectively and the corresponding swing arm, the second arms are moved in the first direction to be fixed at the bottom end, and drive the connector to move in the first direction and drive the first arms, the push drivers and the push follower to move in the second direction.

In order to achieve a part of or all of the above objectives or other objectives, the present invention further provides an electronic apparatus, which includes an electronic device and an electrical connection structure. The electronic device includes a connection interface. The electrical connection structure includes a housing, a connector, a pushing component and a lifting component. The housing has a top portion, a bottom portion opposite to the top portion, and a groove located between the top portion and the bottom portion. The top portion has an opening, and the groove is in communication with the opening. The connector is disposed in the groove. The pushing component is disposed in the groove, and a part of the pushing component is exposed from the opening of the top portion. The lifting component is disposed in the groove and connected between the pushing component and the connector. When the electrical connection structure is connected to the electronic device, the electronic device pushes the pushing component to move in a first direction toward the bottom portion, so that the pushing component drives the lifting component to move in a second direction toward the top portion, the second direction is opposite to the first direction, so that the lifting component lifts up the connector to be connected to the connection interface of the electronic device.

In summary, according to the electronic apparatus of the embodiment of the present invention, the electrical connection structure has the interlocking design between the pushing component and the lifting component. By this interlocking design, the moving distance between the electronic device and the electrical connection structure while being connected to each other is effectively shortened, so that the connection interface of the electronic device can be connected with the connector of the electrical connection structure more quickly and accurately.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
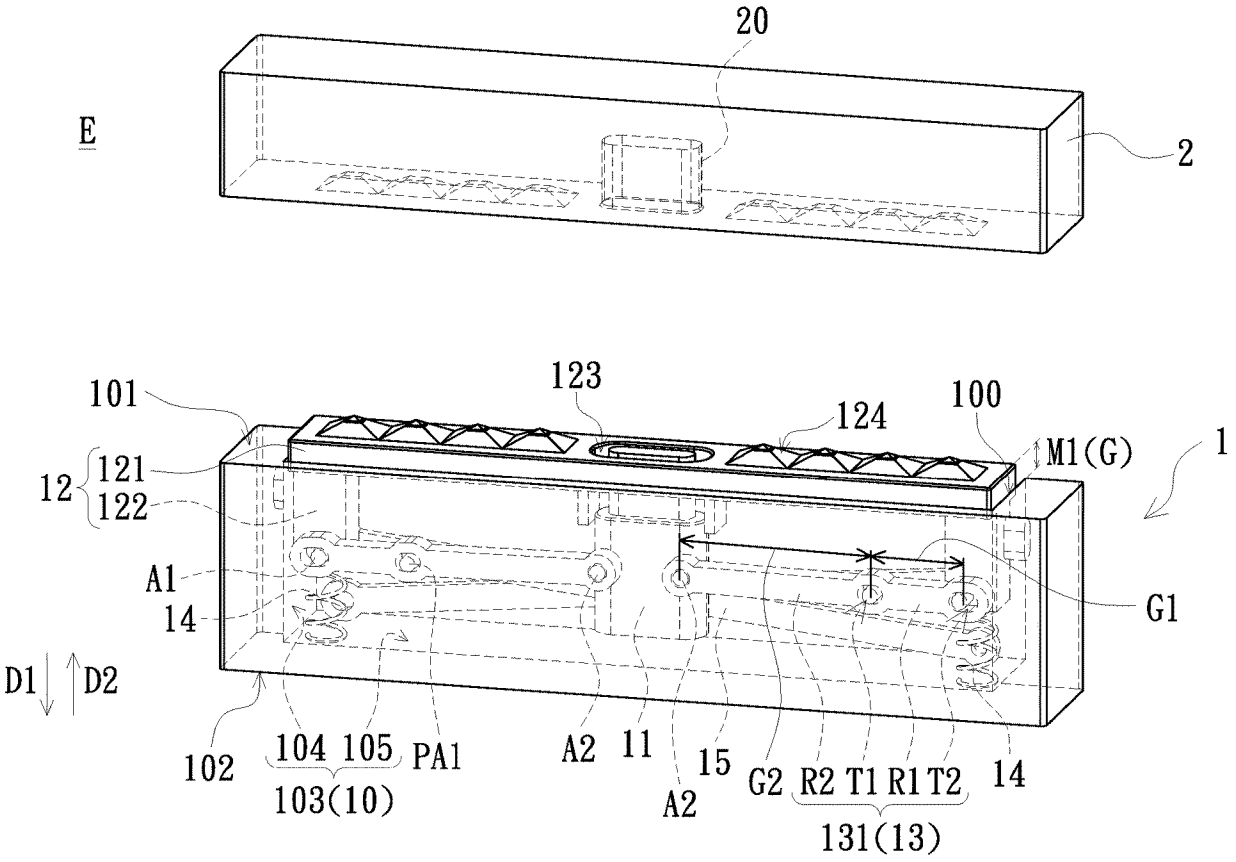
FIG. 1 is a schematic structural view of an electronic apparatus in accordance with an embodiment of the present invention.
Figure 2:
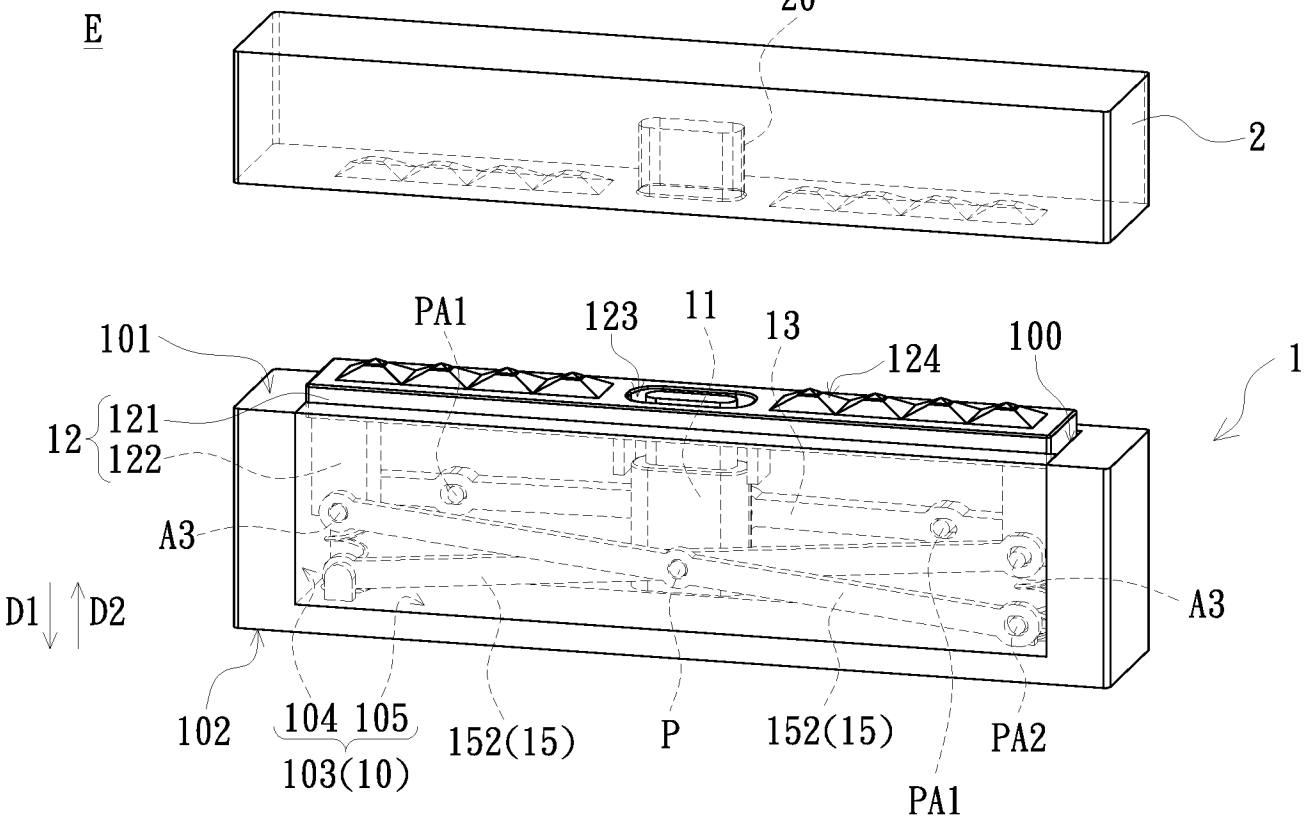
FIG. 2 is a schematic structural view of the electronic apparatus shown in FIG. 1 from another viewing angle.
Figure 3:
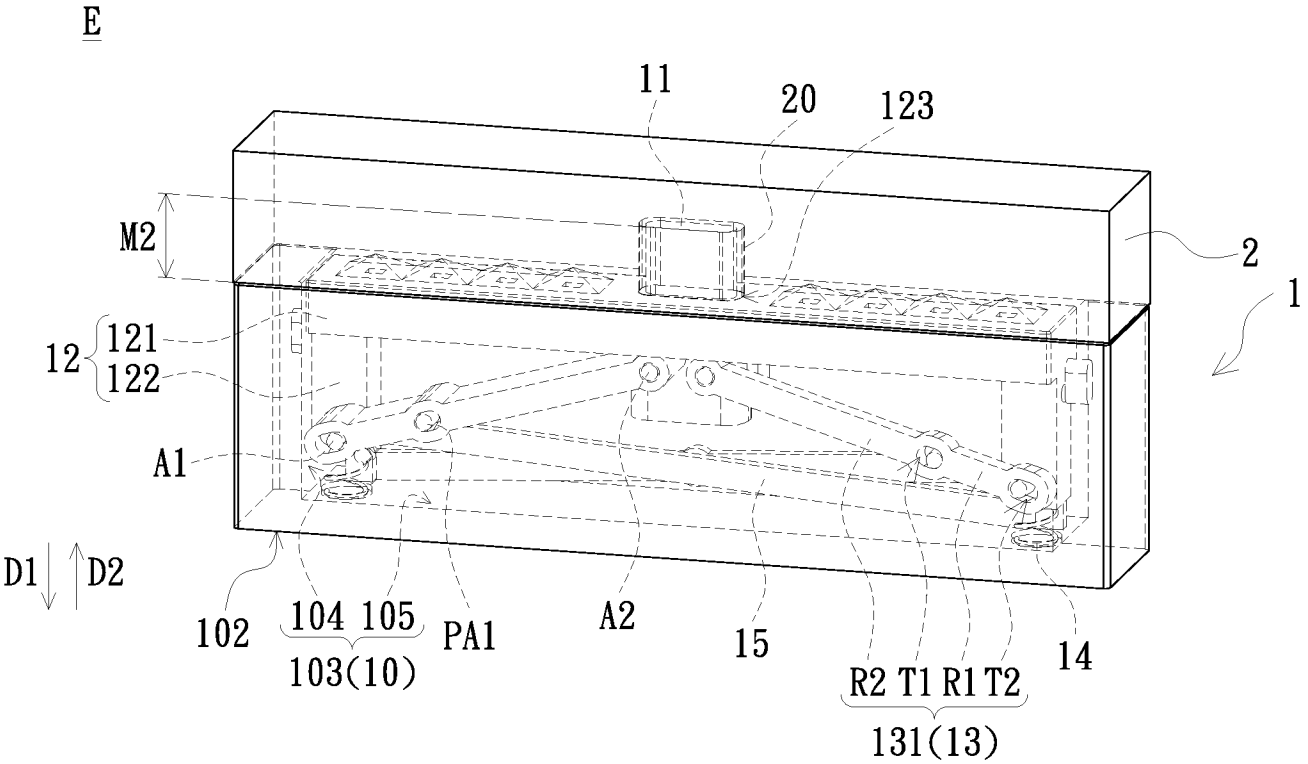
FIG. 3 is a schematic structural view of an electrical connection structure and an electronic device shown in FIG. 1 connected with each other.
Figure 4:
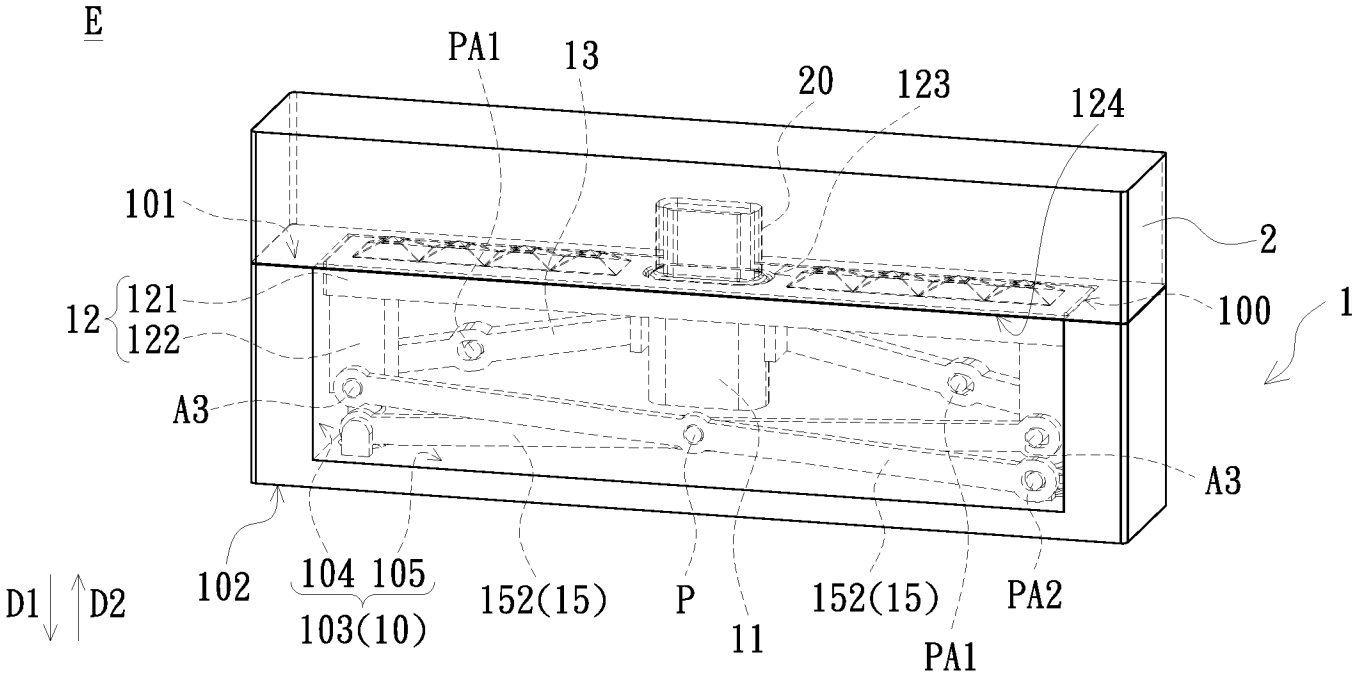
FIG. 4 is a schematic structural view of the electrical connection structure and the electronic device shown in FIG. 3 connected with each other from another viewing angle.

FIG. 1 is a schematic structural view of an electronic apparatus E in accordance with an embodiment of the present invention. FIG. 2 is a schematic structural view of the electronic apparatus E shown in FIG. 1 from another viewing angle. FIG. 3 is a schematic structural view of an electrical connection structure 1 and an electronic device 2 shown in FIG. 1 connected with each other. FIG. 4 is a schematic structural view of the electrical connection structure 1 and the electronic device 2 shown in FIG. 3 connected with each other from another viewing angle. As shown in FIG. 1 to FIG. 4, the electronic apparatus E in the present embodiment includes an electrical connection structure 1 and an electronic device 2. The electrical connection structure 1 is adapted to connect to the electronic device 2. Specifically, the electronic device 2 has a connection interface 20. The electrical connection structure 1 of the present embodiment is adapted to connect to the connection interface 20 of the electronic device 2. In the present embodiment, the electronic device 2 is, for example, a smart phone or a tablet computer, the connection interface 20 is, for example, a universal serial bus (USB) interface or an interface conforming to the Lightning standard, but the present invention is not limited thereto. The electrical connection structure 1 of the present embodiment includes a housing 10, a connector 11, a pushing component 12 and a lifting component 13. The housing 10 has a top portion 101, a bottom portion 102 opposite to the top portion 101, and a groove 103 located between the top portion 101 and the bottom portion 102, wherein the top portion 101 has an opening 100, and the groove 103 is in communication with the opening 100. The connector 11 is disposed in the groove 103 of the housing 10. In the present embodiment, the connector 11 is, for example, an USB connector or a male connector conforming to the Lightning standard, but the present invention is not limited thereto. The pushing component 12 is disposed in the groove 103 of the housing 10, and a part of the pushing component 12 is exposed from the opening 100 of the top portion 101. The lifting component 13 is disposed in the groove 103 of the housing 10, and the lifting component 13 is connected between the pushing component 12 and the connector 11. In the present embodiment, when the electrical connection structure 1 and the electronic device 2 are connected to each other, the electronic device 2 pushes the pushing component 12 to move in the first direction D1 toward the bottom portion 102 of the housing 10, so that the pushing component 12 drives the lifting component 13 to move in the second direction D2 toward the top portion 101 of the housing 10. The second direction D2 is opposite to the first direction D1, so that the lifting component 13 lifts up the connector 11 to be connected with the connection interface 20 of the electronic device 2.

In the following, the details of the structure of the electrical connection structure 1 of the present embodiment will be further described.

As shown in FIG. 1 and FIG. 4, the groove 103 of the housing 10 of the present embodiment further has a side wall 104 and a bottom end 105 adjacent to each other. The side wall 104 of the groove 103 surrounds the connector 11, the pushing component 12 and the lifting component 13. The bottom end 105 of the groove 103 is opposite to the opening 100 of the top portion 101. The pushing component 12 of the present embodiment includes a push follower 121 and at least one push driver 122. The push follower 121 is exposed from the opening 100 of the top portion 101, and the push follower 121 has an opening 123 corresponding to the connector 11. The push drivers 122 of the pushing component 12 extend from the push follower 121 toward the bottom portion 102 of the housing 10 and are respectively located on at least one side of the connector 11. In the present embodiment, the push drivers 122 are respectively located on at least one side of the connector 11. It should be noted that the present embodiment does not limit the number of the push drivers 122. In the case of requiring at least two push drivers 122, the number of push drivers 122 may be increased to more than two according to actual requirements.

In the present embodiment, the push follower 121 further has a contact portion 124 facing the electronic device 2. The opening 123 of the push follower 121 is located at the contact portion 124, and the push follower 121 protrudes from the opening 100 of the top portion 101 so that the contact portion 124 has a gap G from the top portion 101 of the housing 10. By such a structural design, when the electrical connection structure 1 of the present embodiment is connected with the electronic device 2, the push follower 121 of the pushing component 12 can surely contact with the electronic device 2 and be further pushed by the electronic device 2.

As shown in FIG. 1 to FIG. 4, the electrical connection structure 1 in the present embodiment further includes at least one first positioning axis PA1, at least one first axis A1 and at least one second axis A2. The first positioning axes PA1 are disposed on the side wall 104 of the groove 103, the first axes A1 are respectively disposed on the corresponding push drivers 122, and the second axes A2 are disposed on the connector 11. Specifically, the first positioning axes PA1 extend toward the connector 11, and the first axes A1 and the second axes A2 respectively extend away from the connector 11. That is, the extending direction of the first positioning axes PA1 and the extending direction of the first axes A1 and the second axes A2 are opposite to each other.

As shown in FIG. 1 to FIG. 4, the lifting component 13 of the present embodiment includes at least one connecting rod 131. Each connecting rod 131 has a first-sectional connecting rod R1, a second-sectional connecting rod R2, a first sliding slot T1 and a second sliding slot T2. The first sliding slot T1 is located between the first-sectional connecting rod R1 and the second-sectional connecting rod R2, and the first-sectional connecting rod R1 is located between the first sliding slot T1 and the second sliding slot T2. In the present embodiment, the first sliding slots T1 of the connecting rods 131 are pivotally connected to the corresponding first positioning axes PA1, the second sliding slots T2 of the connecting rods 131 are pivotally connected to the corresponding first axis A1, and the second-sectional connecting rods R2 of the connecting rods 131 are respectively pivotally connected to the corresponding second axes A2. As shown in FIG. 3 and FIG. 4, when the electrical connection structure 1 of the present embodiment is connected with the electronic device 2, the electronic device 2 pushes the push follower 121 and the push drivers 122 of the pushing component 12 to move in the first direction D1 toward the bottom portion 102 of the housing 10. The push drivers 122 drive the corresponding connecting rods 131 to rotate with the corresponding first positioning axes PA1 as the fulcrums. That is, the connecting rods 131 respectively perform see-saw motion with the corresponding first positioning axes PA1 as the fulcrum, so as to move the first-sectional connecting rods R1 in the first direction D1 and drive the second-sectional connecting rods R2 to move in the second direction D2 opposite to the first direction D1, thereby causing the second-sectional connecting rods R2 to lift up the connector 11 to pass through the opening 123 of the push follower 121 and to be connected to the connection interface 20 of the electronic device.

As shown in FIG. 1 to FIG. 4, in the present embodiment, each first axis A1 has a first gap G1 from the corresponding first positioning axis PA1, and each second axis A2 has a second gap G2 from the corresponding first positioning axis PA1. In the present embodiment, a specific ratio of the first gap G1 to the second gap G2 is 1/3, that is, a ratio of the first gap G1 to the second gap G2 is 1:3. By the structural design that the specific ratio of the first gap G1 to the second gap G2 is 1/3, the specific ratio of the moving distance M1 of the push follower 121 pushed by the electronic device 2 to the moving distance M2 of the connector 11 lifted by the second-sectional connecting rods R2 is 1/3. For example, when the moving distance M1 of the push follower 121 pushed by the electronic device 2 is 1 cm, the moving distance M2 of the connector 11 lifted by the second-sectional connecting rods R2 is 3 cm. It should be noted that the aforementioned specific ratio 1/3 of the first gap G1 to the second gap G2 is only one of the embodiments of the present invention, and the present invention is not limited thereto. In other embodiments, the specific ratio of the first gap G1 to the second gap G2 is, for example, 1/2, that is, the ratio of the first gap G1 to the second gap G2 is 1:2.

As shown in FIG. 1 to FIG. 4, the electrical connection structure 1 of the present embodiment further includes at least two elastic members 14. The elastic members 14 are respectively disposed between one of the push drivers 122 and the bottom end 105 of the groove 103 and between the other one of the push drivers 122 and the bottom end 105 of the groove 103. When the electrical connection structure 1 of the present embodiment is detached from the electronic device 2 (the state shown in FIG. 1 and FIG. 2), by the elastic restoring force of the elastic members 14, the push drivers 122 are moved toward the second direction D2 to drive the first-sectional connecting rod R1 and the push follower 121 to simultaneously move toward the second direction D2 and to drive the second-sectional connecting rod R2 and the connector 11 to simultaneously move in the first direction D1, so that most of the connector 11 is hidden in the groove 103 of the housing 10.

As shown in FIG. 1 to FIG. 4, the electrical connection structure 1 in the present embodiment further includes at least one third axis A3 and at least one second positioning axis PA2. The third axes A3 are respectively disposed on the sides of the corresponding push driver 122 away from the second axes A2, that is, the third axes A3 and the second axes A2 are respectively disposed on at least one opposite side of the corresponding push driver 122. The second positioning axes PA2 are disposed at the bottom end 105 of the groove 103. In addition, one of the third axes A3 and one of the second positioning axes PA2 are located on one side of the groove 103, and the other one of the third axes A3 and the other one of the second positioning axes PA2 are located on the other side of the groove 103. The electrical connection structure 1 in the present embodiment further includes a supporting component 15 disposed in the groove 103 of the housing 10 and located on the side thereof away from the lifting component 13. That is, the connector 11 and the pushing component 12 are located between the supporting component 15 and the lifting component 13. In the present embodiment, the supporting component 15 includes a first supporting connecting rod 151 and a second supporting connecting rod 152 stacked on top of each other. The first supporting connecting rod 151 is pivotally connected to the second supporting connecting rod 152. One end of the first supporting connecting rod 151 is pivotally connected to the corresponding third axis A3, the other end of the first supporting connecting rod 151 is pivotally connected to the corresponding second positioning axis PA2, one end of the second supporting connecting rod 152 is pivotally connected to the corresponding third axis A3, the other end of the second supporting connecting rod 152 is pivotally connected to the corresponding second positioning axis PA2, and the pivoting connection P between the first supporting connecting rod 151 and the second supporting connecting rod 152 is located between the third axes A3 and also located between the second positioning axes PA2. The effect of the supporting component 15 in the present embodiment is to keep the pushing component 12 moving stably in the first direction D1 toward the bottom portion 102 of the housing 10 and keep the lifting component 13 moving stably in the second direction D2 opposite to the first direction D1 and toward the top portion 101 of the housing 10 when the electrical connection structure 1 and the electronic device 2 are connected to each other, so as to smoothly lift up the connector 11 to connect with the connection interface 20 of the electronic device 2.

Figure 5:
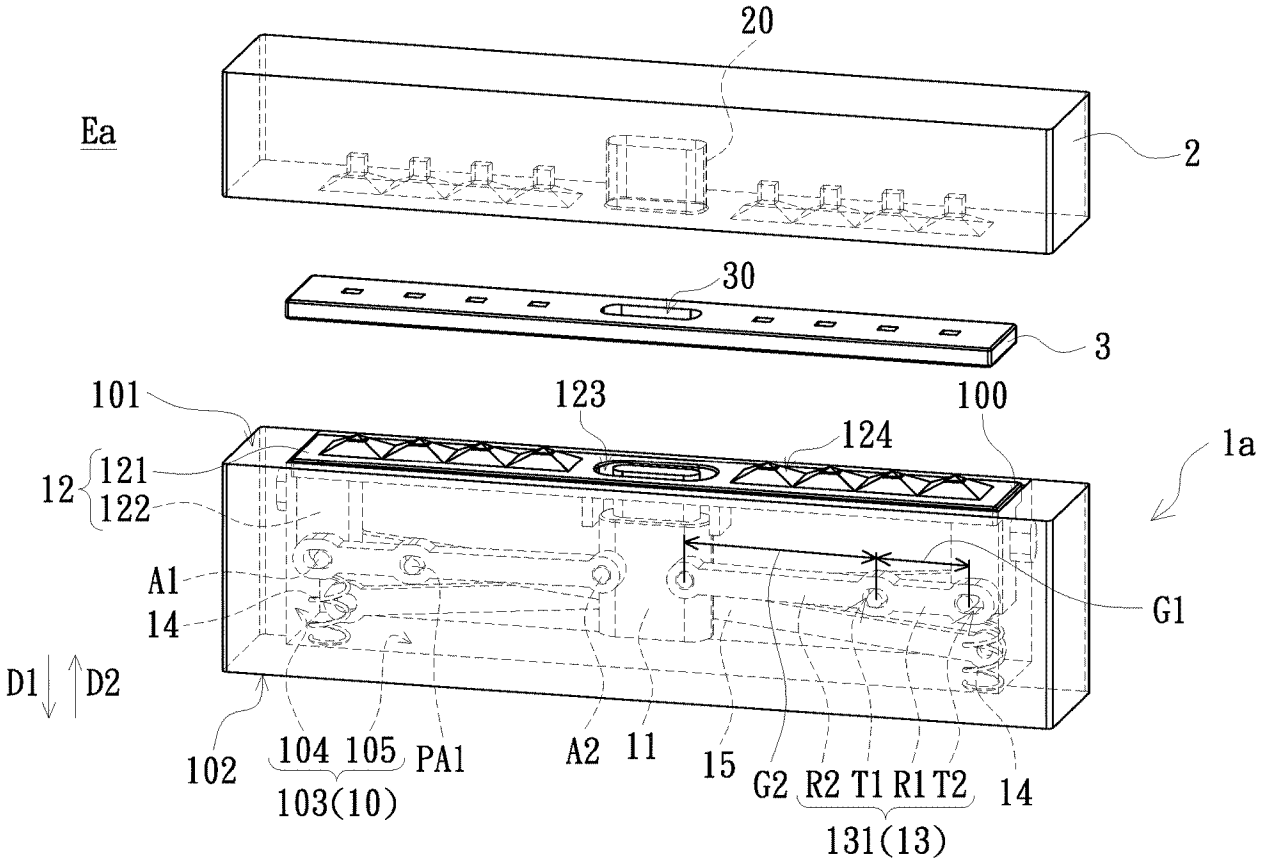
FIG. 5 is a schematic structural view of an electronic apparatus in accordance with another embodiment of the present invention.
Figure 6:
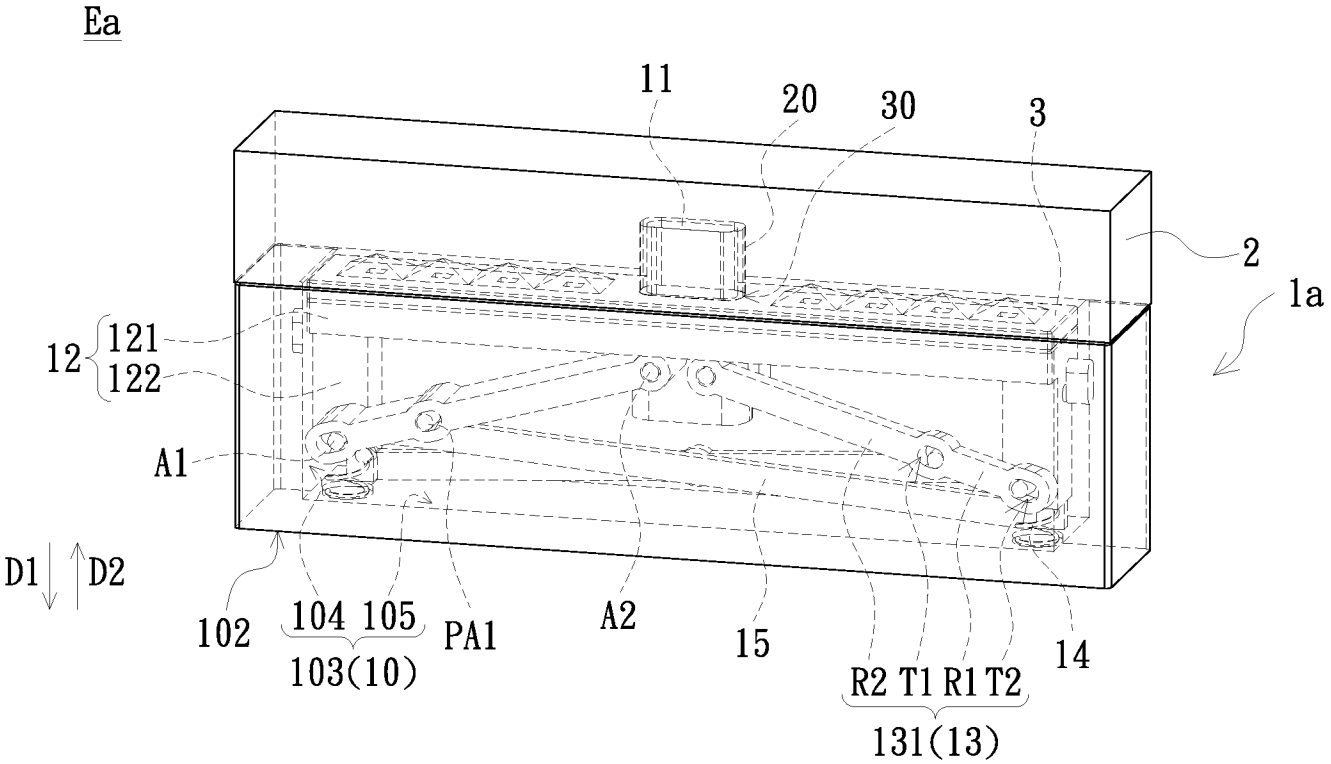
FIG. 6 is a schematic structural view of the electrical connection structure, the electronic device and another electronic device shown in FIG. 5 connected to each other.

FIG. 5 is a schematic structural view of an electronic apparatus Ea in accordance with another embodiment of the present invention. FIG. 6 is a schematic structural view of the electrical connection structure 1*a*, the electronic device 2 and another electronic device 3 shown in FIG. 5 connected to each other. The electronic apparatus Ea of the present embodiment is similar to the electronic apparatus E shown in FIG. 1 to FIG. 4, and the difference lies in that the electronic apparatus Ea of the present embodiment further includes another electronic device 3, and the contact portion 124 of the push follower 121 of the electrical connection structure 1*a* and the top portion 101 of the housing 10 are coplanar with each other. In the present embodiment, another electronic device 3 is, for example, a smart key keyboard, but the present invention is not limited thereto. As shown in FIG. 5 and FIG. 6, when the electrical connection structure 1*a*, the electronic device 2 and another electronic device 3 of the present embodiment are connected to each other, another electronic device 3 pushes the pushing component 12 to move in the first direction D1 toward the bottom portion 102 of the housing 10, so that the pushing component 12 drives the lifting component 13 to move in the second direction D2 toward the top portion 101 of the housing 10. The second direction D2 is opposite to the first direction D1, so that the lifting component 13 lifts up the connector 11 to pass through the opening 30 of another electronic device 3 and to be connected with the connection interface 20 of the electronic device 2.

Figure 7:
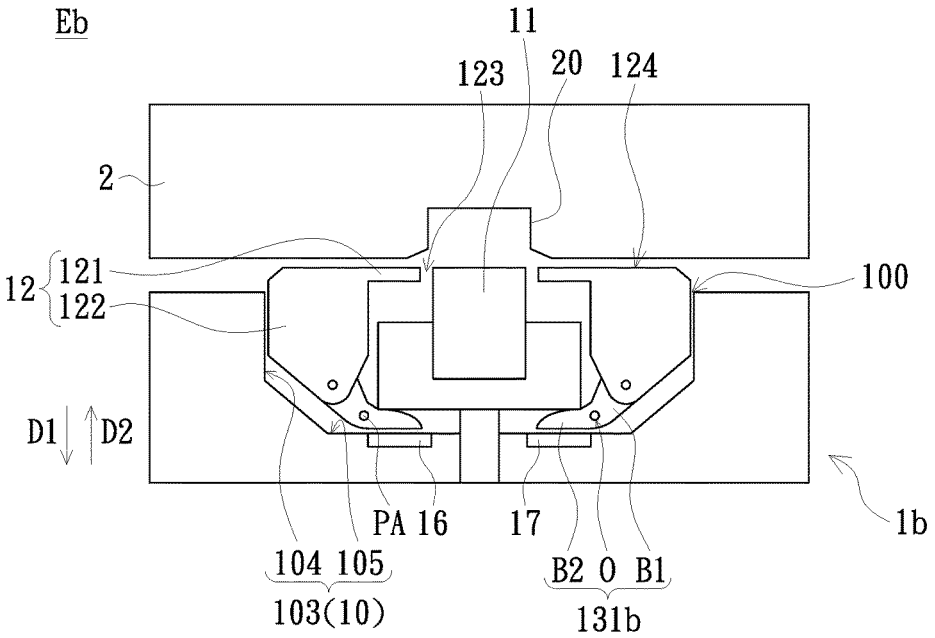
FIG. 7 is a schematic structural view of an electronic apparatus in accordance with another embodiment of the present invention.
Figure 8:
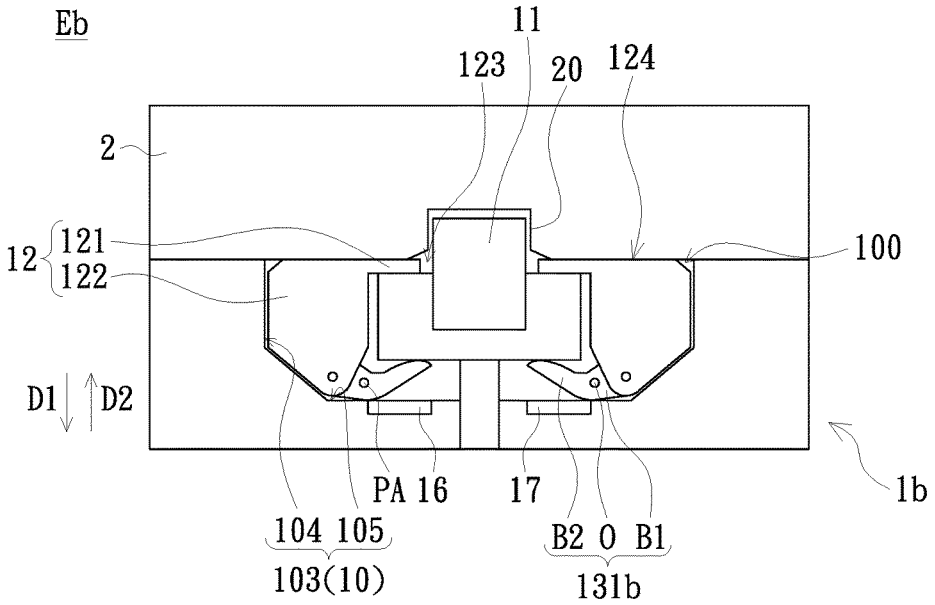
FIG. 8 is a schematic structural view of the electrical connection structure and the electronic device shown in FIG. 7 connected to each other.

FIG. 7 is a schematic structural view of an electronic apparatus Eb in accordance with another embodiment of the present invention. FIG. 8 is a schematic structural view of the electrical connection structure 1*b* and the electronic device 2 shown in FIG. 7 connected to each other. The electronic apparatus Eb of the present embodiment is similar to the electronic apparatus E shown in FIG. 1 to FIG. 4, and the difference lies in that the lifting component 13*b* of the electrical connection structure 1*b* of the present embodiment includes at least one swing arm 131*b*. Each swing arm 131*b* has a first arm B1, a second arm B2 and a pivot hole O. The electrical connection structure 1*b* of the present embodiment further includes at least one positioning axis PA located on the sidewall 104 of the groove 103. The pivot hole O is located between the first arm B1 and the second arm B2. The first arms B1 are respectively pivotally connected to the corresponding push drivers 122. The second arms B2 respectively contact with different sides of the connector 11. In the present embodiment, the second arms B2 respectively contact at least one opposite side of the connector 11. The pivot holes O are respectively pivotally connected to the corresponding positioning axes PA. When the electrical connection structure 1*b* of the present embodiment is connected to the electronic device 2, the electronic device 2 pushes the push follower 121 and the push drivers 122 of the pushing component 12 to move in the first direction D1 toward the bottom portion 102 of the housing 10. The push drivers 122 drive the corresponding swinging arms 131*b* to rotate with the corresponding positioning axes PA as the fulcrums. That is, the swing arms 131*b* respectively perform seesaw motion with the corresponding positioning axes as the fulcrum, so as to move the first arms B1 in the first direction D1 and drive the second arms B2 to move in the second direction D2 opposite to the first direction D1, thereby causing the second-sectional arms B2 to lift up the connector 11 to pass through the opening 123 of the push follower 121 and to be connected to the connection interface 20 of the electronic device.

As shown in FIG. 7 and FIG. 8, the electrical connection structure 1*b* in the present embodiment further includes a first magnetic member 16 and a second magnetic member 17. The first magnetic member 16 is disposed at the bottom end 105 of the groove 103 and corresponds to one of the swing arms 131*b*. The second magnetic member 17 is disposed at the bottom end 105 of the groove 103 and corresponds to the other one of the swing arms 131*b*. In the present embodiment, the swing arms 131*b* are formed of, for example, a metal material that can be attracted by a magnetic force. When the electrical connection structure 1*b* of the present embodiment is detached from the electronic device 2 (as shown in FIG. 7), by the magnetic force between the first magnetic member 16 and the second magnetic member 17 and the corresponding swing arms 131*b*, the second arms B2 are moved in the first direction D1 to be fixed to the bottom end 105 of the groove 103 and further drives the connector 11 to move in the first direction D1 and drives the first arms B1, the push drivers 122 and the push follower 121 to move in the second direction D2 opposite to the first direction D1.

Figure 9:
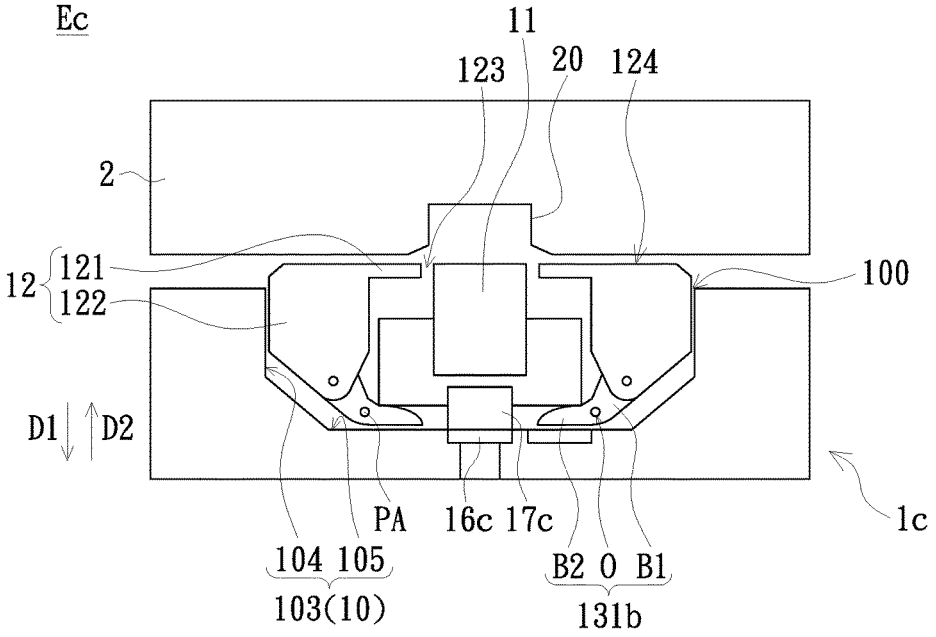
FIG. 9 is a schematic structural view of an electronic apparatus in accordance with another embodiment of the present invention.

FIG. 9 is a schematic structural view of an electronic apparatus Ec in accordance with another embodiment of the present invention. The electronic apparatus Ec of the present embodiment is similar to the electronic apparatus Eb shown in FIG. 7 and FIG. 8, the difference lies in that the first magnetic member 16*c* of the electrical connection structure 1*c* of the present embodiment is disposed at the bottom end 105 of the groove 103, the second magnetic member 17*c* is disposed on the connector 11, and the second magnetic member 17*c* is located between the connector 11 and the first magnetic member 16*c*. When the electrical connection structure 1*c* of the present embodiment is detached from the electronic device 2, by the magnetic force between the first magnetic member 16*c* and the second magnetic member 17*c*, the connector 11 is moved in the first direction D1 to be fixed to the bottom end 105 of the groove 103 and further drives the second arms B2 to move in the first direction D1 and drives the first arms B1, the push drivers 122 and the push follower 121 to move in the second direction D2 opposite to the first direction D1.

Figure 10:
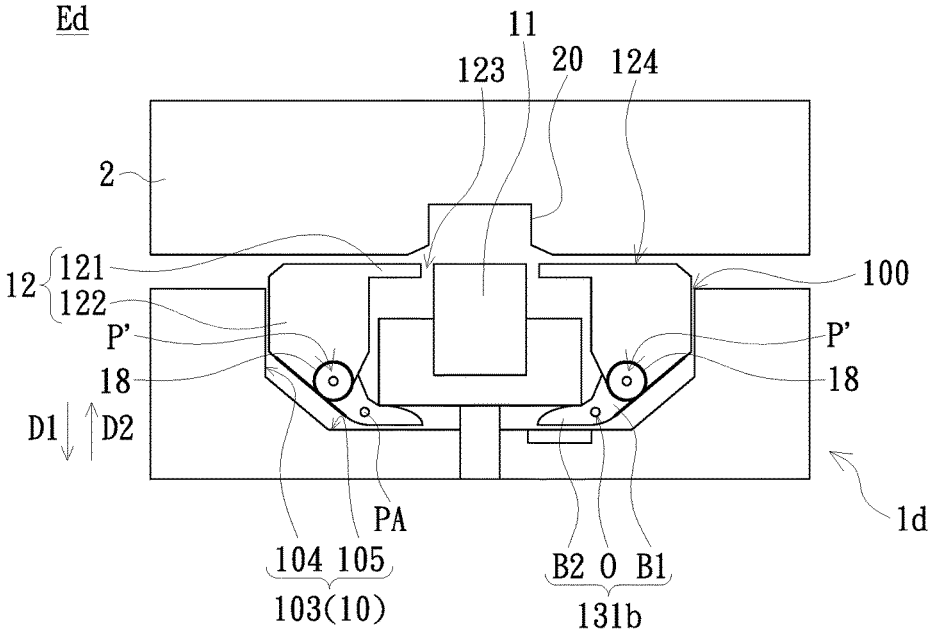
FIG. 10 is a schematic structural view of an electronic apparatus in accordance with another embodiment of the present invention.

FIG. 10 is a schematic structural view of an electronic apparatus Ed in accordance with another embodiment of the present invention. The electronic apparatus Ed of the present embodiment is similar to the electronic apparatus Eb shown in FIG. 7 and FIG. 8, the difference lies in that the electrical connection structure 1*d* in the present embodiment further includes at least one elastic member 18. The elastic members 18 are respectively disposed at the pivot connections P' between the first arms B1 and the corresponding push drivers 122. When the electrical connection structure 1*d* of the present embodiment is detached from the electronic device 2, by the elastic restoring force of the elastic members 18, the first arms B1 are moved in the second direction D2 to drive the second arms B2 and the connector 11 to moves in the first direction D1 and drive the push drivers 122 and the push follower 121 to move in the second direction D2 opposite to the first direction D1.

In summary, according to the electronic apparatus of the embodiment of the present invention, the electrical connection structure has the interlocking design between the pushing component and the lifting component. By this interlocking design, the moving distance between the electronic device and the electrical connection structure while being connected to each other is effectively shortened, so that the connection interface of the electronic device can be connected with the connector of the electrical connection structure more quickly and accurately.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical connection structure adapted to be connected to an electronic device, the electronic device comprising a connection interface, and the electrical connection structure comprising:

a housing, having a top portion, a bottom portion opposite to the top portion, and a groove located between the top portion and the bottom portion, wherein the top portion has an opening, and the groove is in communication with the opening;

a connector, disposed in the groove;

a pushing component, disposed in the groove, wherein a part of the pushing component is exposed from the opening of the top portion; and a lifting component, disposed in the groove and connected between the pushing component and the connector, wherein when the electrical connection structure is connected to the electronic device, the electronic device pushes the pushing component to move in a first direction toward the bottom portion, so that the pushing component drives the lifting component to move in a second direction toward the top portion, the second direction is opposite to the first direction, so that the lifting component lifts up the connector to be connected to the connection interface.

2. The electrical connection structure according to claim 1, wherein the groove of the housing further has a side wall and a bottom end adjacent to each other, the side wall surrounds the connector, the pushing component and the lifting component, and the bottom end is opposite to the opening.

3. The electrical connection structure according to claim 2, wherein the pushing component comprises a push follower exposed from the opening of the top portion and having an opening corresponding to the connector.

4. The electrical connection structure according to claim 3, wherein the pushing component comprises a push driver extending from the push follower toward the bottom portion of the housing and respectively located on at least one side of the connector.

5. The electrical connection structure according to claim 3, wherein the push follower further has a contact portion facing the electronic device, and the opening is located at the contact portion.

6. The electrical connection structure according to claim 4, further comprising at least one first positioning axis, at least one first axis and at least one second axis, wherein the first positioning axes are disposed on the side wall of the groove, the first axes are respectively disposed on one side of the corresponding push driver, and the second axes are disposed on the connector.

7. The electrical connection structure according to claim 6, wherein the lifting component comprises at least one connecting rod, each connecting rod has a first-sectional connecting rod, a second-sectional connecting rod, a first sliding slot and a second sliding slot, the first-sectional connecting rod is located between the first sliding slot and the second sliding slot, the second-sectional connecting rods are respectively pivotally connected to the corresponding second axis, the first sliding slot is located between the first-sectional connecting rod and the second-sectional connecting rod and respectively pivotally connected to the corresponding first positioning axis, and the second sliding slots are respectively pivotally connected to the corresponding first axis.

8. The electrical connection structure according to claim 4, further comprising at least one elastic member, wherein the elastic members are respectively disposed between the push drivers and the bottom end of the groove.

9. The electrical connection structure according to claim 6, wherein each first axis has a first gap from the corresponding first positioning axis, each second axis has a second gap from the corresponding first positioning axis, and a specific ratio of the first gap to the second gap is between 1/3 and 1/2.

10. The electrical connection structure according to claim 6, further comprising at least one third axis and at least one second positioning axis, the third axes are respectively disposed on one side of the corresponding push driver away from the second axis, and the second positioning axis is disposed at the bottom end of the groove.

11. The electrical connection structure according to claim 10, wherein the third axes and the second positioning axes are located on one side of the groove.

12. The electrical connection structure according to claim 10, further comprising a supporting component disposed in the housing and located on a side thereof away from the lifting component.

13. The electrical connection structure according to claim 12, wherein the supporting component comprises a first supporting connecting rod and a second supporting connecting rod stacked on top of each other, and the first supporting connecting rod is pivotally connected to the second supporting connecting rod.

14. The electrical connection structure according to claim 12, wherein one end of the first supporting connecting rod is pivotally connected to the corresponding third axis and the other end of the first supporting connecting rod is pivotally connected to the corresponding second positioning axis.

15. The electrical connection structure according to claim 12, wherein one end of the second supporting connecting rod is pivotally connected to the corresponding third axis and the other end of the second supporting connecting rod is pivotally connected to the corresponding second positioning axis.

16. The electrical connection structure according to claim 12, a pivoting connection between the first supporting connecting rod and the second supporting connecting rod is located between the third axes and the second positioning axes.

17. The electrical connection structure according to claim 2, further comprising at least one positioning axis, and the positioning axes are disposed on the side wall of the groove.

18. The electrical connection structure according to claim 17, wherein the lifting component comprises at least one swinging arm, each swinging arm has a first arm, a second arm and a pivot hole, the first arms are respectively pivotally connected to the corresponding push driver, the second arms are respectively contacted with different sides of the connector, and the pivot hole is located between the first arm and the second arm and are pivotally connected to the corresponding positioning axis.

19. The electrical connection structure according to claim 18, further comprising at least one elastic member respectively disposed at a pivoting connection between the first arms and the corresponding push driver.

20. The electrical connection structure according to claim 18, further comprising a first magnetic member and a second magnetic member, wherein the first magnetic member is disposed at the bottom end of the groove, the second magnetic member is disposed on the connector, and the second magnetic member is located between the connector and the first magnetic member.

21. The electrical connection structure according to claim 18, further comprising a first magnetic member and a second magnetic member, wherein the first magnetic member is disposed at the bottom end of the groove and corresponds to one of the swing arms, and the second magnetic member is disposed at the bottom end of the groove and corresponds to the other one of swing arms.

22. An electronic apparatus, comprising:

an electronic device, comprising a connection interface; and an electrical connection structure, comprising:

a housing, having a top portion, a bottom portion opposite to the top portion, and a groove located between the top portion and the bottom portion, wherein the top portion has an opening, and the groove is in communication with the opening;

a connector, disposed in the groove;

a pushing component, disposed in the groove, wherein a part of the pushing component is exposed from the opening of the top portion; and a lifting component, disposed in the groove and connected between the pushing component and the connector, wherein when the electrical connection structure is connected to the electronic device, the electronic device pushes the pushing component to move in a first direction toward the bottom portion, so that the pushing component drives the lifting component to move in a second direction toward the top portion, the second direction is opposite to the first direction, so that the lifting component lifts up the connector to be connected to the connection interface of the electronic device.

* * * * *